US008422871B2

(12) United States Patent
Mochizuki

(10) Patent No.: US 8,422,871 B2
(45) Date of Patent: Apr. 16, 2013

(54) IMMERSION HEATER

(75) Inventor: Shunji Mochizuki, Fujinomiya (JP)

(73) Assignee: Tounetsu Corporation, Shizuoka (JP)

( * ) Notice: Subject to any disclaimer, the term of this patent is extended or adjusted under 35 U.S.C. 154(b) by 364 days.

(21) Appl. No.: 12/864,118

(22) PCT Filed: Jan. 22, 2009

(86) PCT No.: PCT/JP2009/050972
§ 371 (c)(1),
(2), (4) Date: Jul. 22, 2010

(87) PCT Pub. No.: WO2009/096311
PCT Pub. Date: Aug. 6, 2009

(65) Prior Publication Data

US 2010/0290766 A1 Nov. 18, 2010

(30) Foreign Application Priority Data

Jan. 29, 2008 (JP) ..... 2008-017579

(51) Int. Cl.
*H05B 3/40* (2006.01)

(52) U.S. Cl.
USPC ..... 392/503; 392/497; 219/270

(58) Field of Classification Search ..... None
See application file for complete search history.

(56) References Cited

U.S. PATENT DOCUMENTS

| | | | | |
|---|---|---|---|---|
| 1,609,688 | A * | 12/1926 | Briggs | 123/145 A |
| 4,426,568 | A * | 1/1984 | Kato et al. | 219/270 |
| 5,075,536 | A * | 12/1991 | Towe et al. | 219/270 |
| 5,084,606 | A * | 1/1992 | Bailey et al. | 219/270 |
| 5,791,308 | A * | 8/1998 | Carter et al. | 123/145 A |
| 5,850,073 | A * | 12/1998 | Eckert | 219/523 |
| 7,012,226 | B1 * | 3/2006 | George | 219/544 |
| 7,989,739 | B2 * | 8/2011 | Eckert | 219/548 |

FOREIGN PATENT DOCUMENTS

| | | | |
|---|---|---|---|
| EP | 0 650 020 | | 4/1995 |
| JP | 53-125546 | | 10/1978 |
| JP | 58-115792 | | 7/1983 |
| JP | 63273728 | A * | 11/1988 |
| JP | 64-17387 | | 1/1989 |
| JP | 5-21275 | | 5/1993 |
| JP | 7-119969 | | 5/1995 |
| JP | 7-249477 | | 9/1995 |

OTHER PUBLICATIONS

Patent Cooperation Treaty (PCT) International Preliminary Report on Patentability issued Sep. 10, 2010 in corresponding International Application No. PCT/JP2009/050972.
International Search Report issued Apr. 21, 2009 in International (PCT) Application No. PCT/JP2009/050972.

* cited by examiner

*Primary Examiner* — Thor Campbell
(74) *Attorney, Agent, or Firm* — Wenderoth, Lind & Ponack, L.L.P.

(57) ABSTRACT

An immersion heater capable of completely avoiding a situation where an outer circumferential border of a spiral heating element is pressed to an inner wall of a protecting tube, and preventing disconnection due to contact between adjacent portions of the heating element. In the immersion heater, one edge portion of a metal strip heating element (8) is inserted into, and held in a spiral groove (7) to form a spiral heating part (9). Cylindrical-body supporting members (11) are provided and each has a diameter smaller than an inner diameter of the ceramic bottom protecting tube (2) and larger than an outer diameter of the spiral heating part. The cylindrical-body supporting members are fitted into a hollow portion of the insulating cylindrical body (6) and are arranged in openings at a fore-end and a back-end of the insulating cylindrical body, respectively.

11 Claims, 7 Drawing Sheets

IMMERSION HEATER

BACKGROUND OF THE INVENTION

1. Technical Field

The present invention relates to an immersion heater, for example, for use in heating equipment for molten metal such as an aluminum holding furnace, and particularly relates to an immersion heater including a metal heating element of an Fe—Cr—Al based alloy or the like.

2. Description of the Related Art

Conventionally, as an immersion heater for use in molten metal such as molten aluminum, there has been an immersion heater employing a metal heating element. For example, in Japanese Utility Model Application Laid-Open No. 5-21275, there is disclosed an immersion heater having an insulating cylindrical body arranged so as to be suspended inside a ceramic protecting tube (immersion tube) having a bottomed cylindrical shape, a wire heating element (heating part) having a circular cross section arranged inside a spiral groove formed in an outer circumference portion of this insulating cylindrical body, and an insulating cover closing an opening end of the ceramic protecting tube, and one end of each terminal rod is connected to the wire heating element, and the other end of the terminal rod passes through the insulating cover.

SUMMARY OF THE INVENTION

1. Problems to be Solved by the Invention

However, since the immersion heater of the above-described JP 5-21275 is configured to hold, suspended inside the protecting tube, the insulating cylindrical body into which the wire heating element is fitted, in a case that a strip metal heating element which is wound spirally is employed, and that planar portions of the strip heating element are spiral heating portions opposed to each other, the following problem arises.

Specifically, once misalignment between the protecting tube and the cylindrical body is caused, an outer circumference border of the strip heating element, which is wound spirally, is pressed to an inner wall of the protecting tube, resulting in trouble that the heating element is deformed in this pressed portion to come into contact with an adjacent portion of the heating element. Especially in a horizontal dip method, horizontal cantilever supporting in which a back-end portion of an immersion heater is supported by a side wall of the furnace is employed, and thus, the heating element is similarly supported by the horizontal cantilever, and additionally, weights of the cylindrical body and the heating element themselves are added, thereby causing downward deflection, which brings about a state where the lower outer circumference border (on the hearth side) of the spiral heating element is likely to be pressed to an inner wall of the protecting tube. This increases a possibility of causing the foregoing trouble.

Consequently, an object of the present invention is to provide an immersion heater capable of completely avoiding a situation where an outer circumference border of a spiral heating element is pressed to an inner wall of a protecting tube, and preventing disconnection due to contact between adjacent portions of the heating element.

2. Means for Solving the Problems

To achieve the above object, an immersion heater of the present invention includes a ceramic bottomed protecting tube, an insulating cylindrical body inserted into said ceramic bottomed protecting tube, a metal heating element held inside a spiral groove formed in an outer circumference surface of said insulating cylindrical body, an insulating cover closing an opening portion of said ceramic bottomed protecting tube, and first and second terminal rods, one-end portions of which are connected to a fore-end portion and a back-end portion of said metal heating element, respectively, and other-end portions of which pass through said insulating cover and are located outside said ceramic bottomed protecting tube. The metal heating element is a strip heating element, and one edge portion of this strip heating element is inserted into, and held in said spiral groove to form a spiral heating part, and cylindrical-body supporting members that each have a diameter smaller than an inner diameter of said ceramic bottom protecting tube and larger than an outer diameter of the spiral heating part and are fitted into a hollow portion of said insulating cylindrical body are arranged in openings at a fore-end and a back-end of said insulating cylindrical body, respectively.

According to the immersion heater having this configuration, since employing the strip heating element can increase a surface area of the heating element, the temperature of the heating element can be kept lower at the same output as compared with a wire heating element, and durability is improved by suppression of scaling loss and the like.

Moreover, since the cylindrical-body supporting members attached to both ends of the cylindrical body holding the strip heating element as the spiral heating part each have the diameter smaller than the inner diameter of the protecting tube and larger than the outer diameter of the spiral heating part, a gap between an outer circumference border of the strip heating element and an inner wall surface of the protecting tube is securely formed, by which a situation where the outer circumference border of the spiral heating part is pressed to the inner wall of the protecting tube can be avoided, and as a result, deformation due to the pressing of the outer circumference border of the strip heating element is not caused, and the disconnection by contact between the adjacent portions of strip heating element can be securely avoided.

In the immersion heater of the present invention, a through-hole through which said first terminal rod connected to the fore-end portion of said metal heating element passes and a notched portion through which a connection plate joined and fixed to a fore-end of said first terminal rod is inserted may be formed in said cylindrical-body supporting member on the fore-end side, and a through-hole through which said first terminal rod passes, and a notched portion through which a connection plate joined and fixed to a fore-end of said second terminal rod is inserted may be formed in said cylindrical-body supporting member on the back-end side.

According to the immersion heater having this configuration, connection work between the connection plate and the metal heating element can be performed easily and electric connection can be securely performed.

In the immersion heater of the present invention, a space between said cylindrical-body supporting member on the back-end side and said cover inside said protecting tube may be packed with a thermal insulator.

According to the immersion heater having this configuration, heat transfer from the spiral heating part to the terminal parts is suppressed, so that deformation due to thermal expansion of the terminal rod can be prevented, and in a horizontal dip method, molten metal can be prevented from flowing outside when the protecting tube is damaged.

In addition, an outer circumference portion on an opening end portion side of said ceramic bottomed protecting tube may be formed into a taper shape that is tapered toward a fore-end thereof.

According to the immersion heater having this configuration, providing a heater attachment port engaged with the tapered outer circumference portion in a furnace side wall when the immersion heater is attached to the furnace side wall enables precise positioning and robust attachment of the heater.

In the immersion heater of the present invention, said terminal rod fixed to said cylindrical-body supporting member on the fore-end side so as to be connected to the fore-end portion of said metal heating element may pass through said cylindrical body, said cylindrical-body supporting member on the back-end side and said cover to extend, and a compression spring may be arranged between a fastener provided in said terminal rod and said cover outside said cover.

According to the immersion heater having this configuration, a tension is constantly given to the terminal rod, which can suppress the deformation due to thermal expansion of the terminal rod.

In the immersion heater of the present invention, said terminal rod connected to the fore-end portion of said metal heating element may be formed into a pipe shape, and a thermocouple is inserted into, and arranged in said pipe-shaped terminal rod.

According to the immersion heater having this configuration, inserting and arranging the thermocouple inside the pipe-shaped terminal rod enables precise temperature measurement inside the cylindrical body having the heating part. In this case, packing a fore-end opening of the pipe-shaped terminal rod with a thermal insulator can prevent the molten metal from flowing outside through an inside of the pipe-shaped terminal rod when a fore-end portion of the protecting tube is damaged.

In the immersion heater of the present invention, an insulating cylindrical spacer may be arranged between said cylindrical-body supporting member on the back-end side and said cover in a state where said insulating cylindrical spacer contains said terminal rod.

According to the immersion heater having this configuration, one end portion of the cylindrical spacer abuts on the cylindrical-body supporting member on the back-end side and another end portion thereof abuts on the cover, respectively, and this can make the position of the cylindrical body and the heating part inside the protecting tube precisely constant.

In the immersion heater of the present invention, a plurality of through-openings may be formed in a circumference wall of said insulating cylindrical body.

According to the immersion heater having this configuration, directly giving radiation heat of the strip heating body through the through-holes increases responsiveness of the temperature measurement by the thermocouple, and forming the through-holes decreases a heat capacity of the cylindrical body holding the heating element, resulting in reduction in power consumption.

DESCRIPTION OF THE REFERENCE NUMERALS

Figure 1:
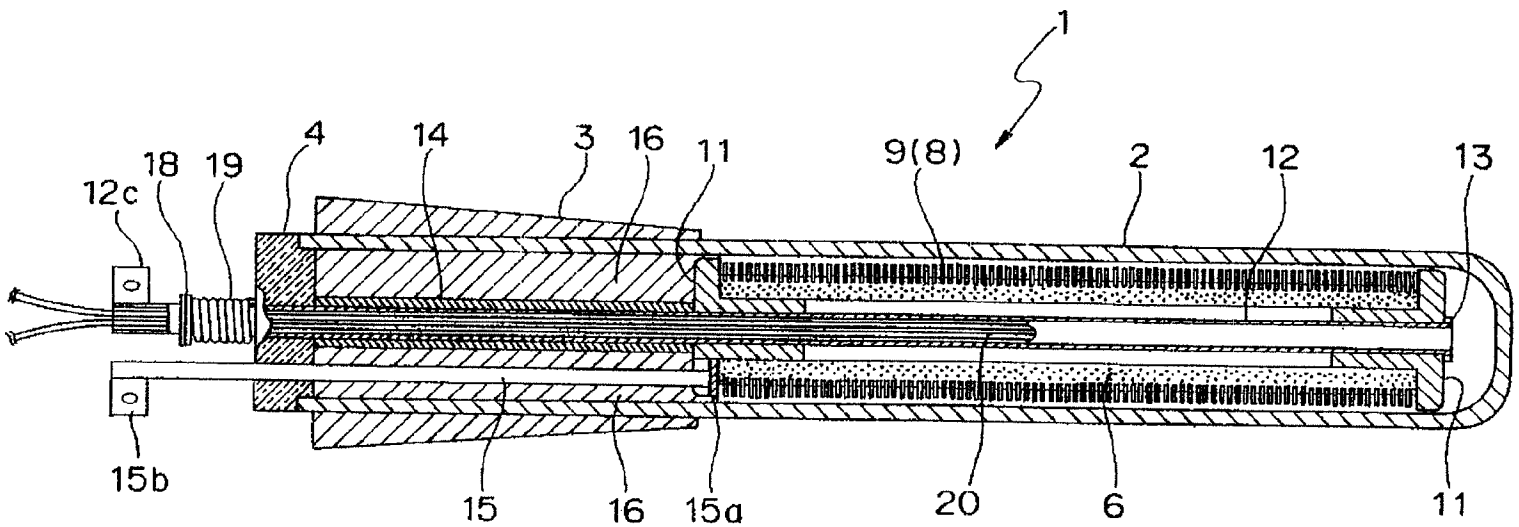
FIG. 1 is an axial cross-sectional view of an immersion heater.

1 . . . Immersion heater
2 . . . Protecting tube
3 . . . Taper member
4 . . . Cover
6 . . . Cylindrical body
7 . . . Spiral groove
8 . . . Heating element
9 . . . Heating part
10 . . . Through-opening
11 . . . Cylindrical-body supporting member
12 . . . First terminal rod
13 . . . Connection plate
14 . . . Spacer
15 . . . Second terminal rod
16 . . . Packing material
18 . . . Fastener
19 . . . Coil spring (compression spring)
20 . . . Thermocouple

DETAILED DESCRIPTION OF THE INVENTION

Hereinafter, referring to the accompanying drawings, embodiments of the present invention are described.

FIG. 1 is a longitudinal (axial) cross-sectional view of an immersion heater 1 as one embodiment of the present invention. In describing the immersion heater 1, for the sake of convenience, an end portion on a side that is inserted into a furnace at the time of attachment to the furnace is referred to as a "fore-end", and an end portion on the opposite side is referred to as a "back-end".

The immersion heater 1 includes a protecting tube 2 made of ceramics. The protecting tube 2 is made of silicon nitride-based fine ceramics or the like, and is formed into a bottomed cylindrical body with a fore-end closed and another end opened. A taper member 3 is fixed to an outer circumference portion in a back-end portion of the protecting tube 2 so as to form a part of the protecting tube 2. The taper member 3 is made of ceramics similar to the protecting tube 2, and an outer circumference surface thereof is formed into a taper shape, which is tapered toward the fore-end side. The outer circumference taper shape of this taper member 3 corresponds to a taper shape of an inner circumference surface of a heater attaching port of a furnace side wall (not shown) on which the immersion heater 1 is mounted. Thereby, when the immersion heater is attached to the furnace-side wall from the outside, by engaging the taper-shaped outer circumference surface of the taper member 3 of the protecting tube 2 with the taper-shaped inner circumference surface of the heater attaching port, precise alignment and robust attachment of the immersion heater 1 is enabled. The taper member 3 may be formed integrally with the protecting tube 2 in advance.

Figure 2:
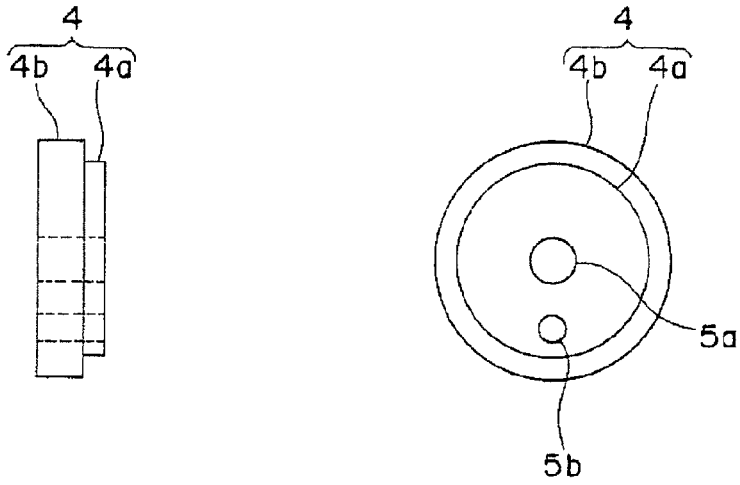
FIG. 2 is a front elevational view and a side elevational view of a cover.

A back-end opening portion of the protecting tube 2 is closed by a cover 4 made of an electrical and thermal insulating material such as a glass-fiber reinforced composite. The cover 4 has a disk-shaped insertion portion 4*a* of a small diameter that is inserted into the opening portion of the protecting tube 2, and a flange portion 4*b* of a large diameter that abuts on an opening rim portion of the protecting tube 2, as shown in a front elevational view and a side elevational view of FIG. 2. In the cover 4, through-holes 5*a*, 5*b* to pass terminal rods 12, 15 described later through are formed. One of the though-holes 5*a* is formed in the center of the substantially disk-shaped cover 4, and the other through-hole 5*b* is formed closer to an outer circumference of the cover 4.

Figure 3A:
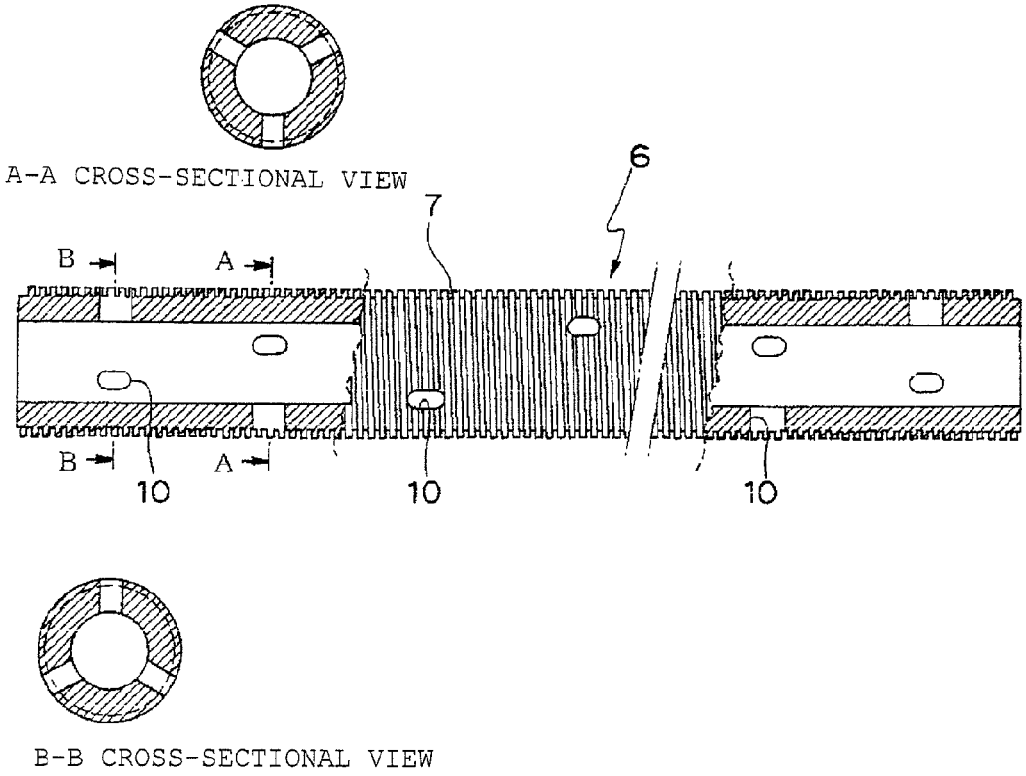
FIG. 3A is a side elevational view of a cylindrical body including a partial cross section.
Figure 3B:
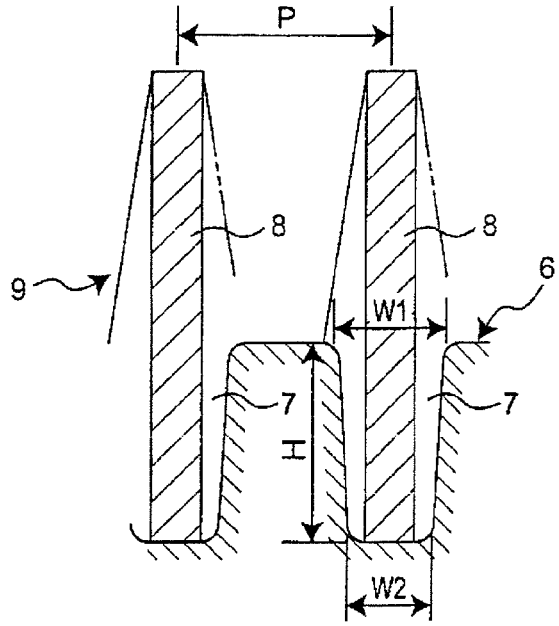
FIG. 3B is an enlarged view of a spiral groove of the cylindrical body and a heating element.

A cylindrical body 6 made of an electrical and thermal insulating material such as ceramics having an alumina content of not less than 90% is inserted into and arranged in the protecting tube 2. In an outer circumference surface of the cylindrical body 6, a spiral groove 7 continuing from a fore-end to a back-end is formed as shown in FIG. 3A. The spiral groove 7 is formed in a taper shape in which a dimension between both side walls becomes narrower toward a bottom, as shown in FIG. 3B. While in the present embodiment, a depth of the groove H: 4 mm, a groove width on a surface side $W_1$: 2.3 mm, a groove width on a bottom side $W_2$: 1.7 mm, and a pitch of the groove P: 4.8 mm, the present invention is not limited to these.

In the spiral groove 7, one edge portion of a strip (in the embodiment, a width 10 mm, and a thickness of 1 mm, but not limitative) heating element 8 made of a metal such as a Fe—Cr—Al based alloy, for example, is held and the other edge portion of the heating element 8 is projected, for example, by about 6 to 7 mm from the outer circumference surface of the cylindrical body 6. This constructs a spiral heating part 9 continuing from the fore-end to the back-end in an outer circumference portion of the cylindrical body 6.

Figure 3C:
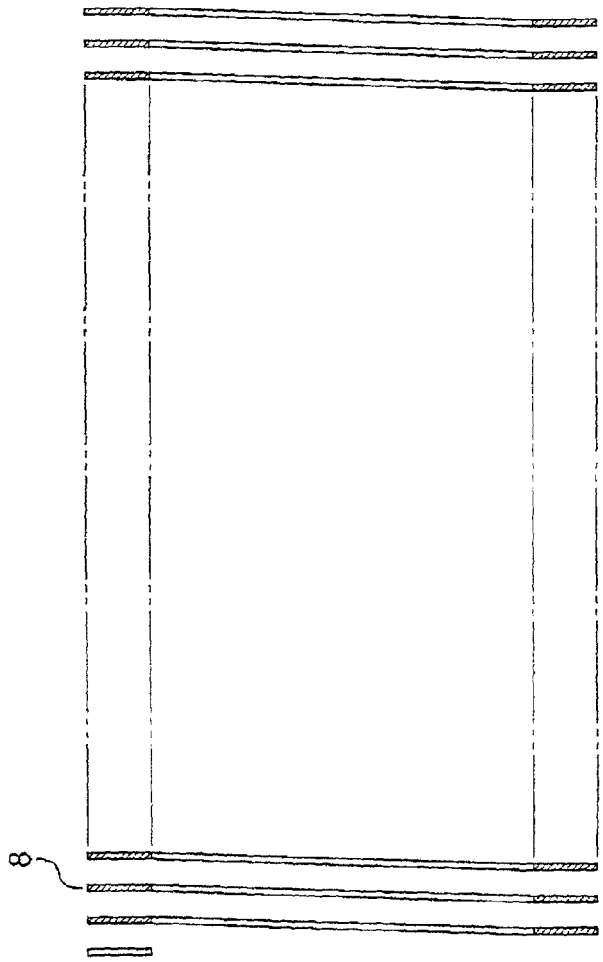
FIG. 3C is a cross-sectional view of the heating element.

The strip heating element 8 is spirally formed in advance so that planar portions thereof are opposed to each other, as shown in FIG. 3C, and a fore-end of the spiral heating element 8 is located inside the spiral groove 7 of the cylindrical body 6 and rotated relatively to be loaded into the spiral groove 7.

Moreover, through-openings 10 are formed in a wall of the cylindrical body 6 as shown in FIG. 3A. In the present embodiment, the through-openings 10 are formed into a substantially elliptical, long-hole shape, and as shown in an A-A cross section, and in a B-B cross section, three through-openings 10 are formed at a circumferentially even pitch in a plane perpendicular to an axial direction. Displacing formation positions of the through-openings 10 by 60 degrees between the A-A cross section and the B-B cross section is to suppress decrease in strength of the cylindrical body 6. The through-openings 10 of a plurality of sets, each of which is made by the three through-openings in the circumferential direction as described above, are formed in the axial direction of the cylindrical body 6. In this manner, forming the numerous through-openings 10 in the cylindrical body 6 allows radiation heat of the heating element 8 to be given directly to a thermocouple 20 arranged inside the cylindrical body 6 as will be described through the through-openings 10, which increases responsiveness of temperature measurement by the thermocouple 20, and forming the through-openings 10 decreases a heat capacity of the cylindrical body 6 holding the heating element 8, resulting in reduction in power consumption. The shape, size, number, formation positions and the like of the through-openings 10 are not limited to the foregoing, and can be changed as needed.

Figure 4:
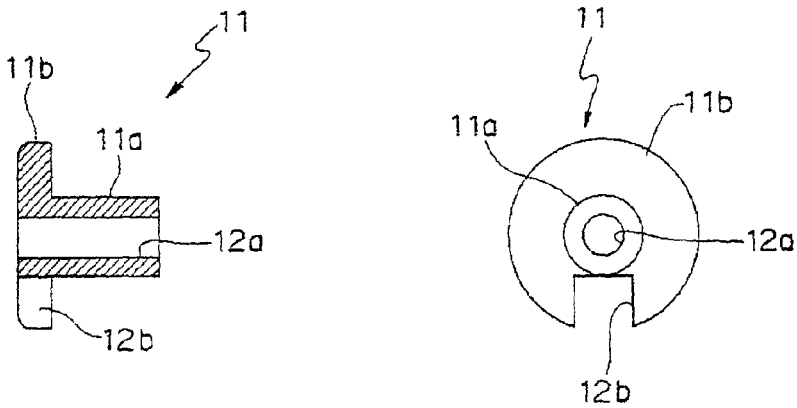
FIG. 4 is a front elevational view and a cross-sectional view of a cylindrical-body supporting member.
Figure 6:
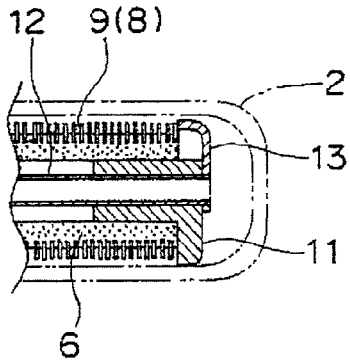
FIG. 6 is a view showing a connected state of the connection plate fixed to the first terminal rod, to the heating element.

Cylindrical-body supporting members 11 made of an electrical and thermal insulating material such as ceramics having an alumina content of 70 to 80% are attached to the fore-end and the back-end of the cylindrical body 6, respectively. As shown in the front elevational view and the cross-sectional view of FIG. 4, each of the cylindrical-body supporting members 11 is made up of a cylindrical fitting portion 11*a* that fits into a hollow portion of the cylindrical body 6 from each end opening of the cylindrical body 6, and a flange portion 11*b* that abuts on each end surface of the cylindrical body 6. In the center of the cylindrical-body supporting member 11, a through-hole (insertion port) 12*a* into which the terminal rod 12 described later is inserted is formed, and a substantially rectangular notched portion (insertion port) 12*b* is formed in an outer circumference portion of the flange portion 11*b*. As shown in FIG. 6, a connection plate 13 of the terminal rod 12 described later is inserted through the notched portion 12*b* of the cylindrical-body supporting member 11 attached to the fore-end of the cylindrical body 6, and as shown in FIG. 1, the terminal rod 15 described later is inserted through the notched portion 12*b* of the cylindrical-body supporting member 11 attached to the back-end of the cylindrical body 6.

The flange portions 11*b* of the respective cylindrical-body supporting members 11 attached to the front and the back of the cylindrical body 6 each have a diameter smaller than an inner diameter of the protecting tube 2 and larger than an outer diameter of the spiral heating part 9. This allows a gap to be securely formed between an inner circumference surface of the protecting tube 2 and an outer circumference border of the heating part 9, which securely prevents the heating part 9 (i.e., the strip heating element 8 constructing this) from being pressed to the inner circumference surface of the protecting tube 2.

Figure 5A:
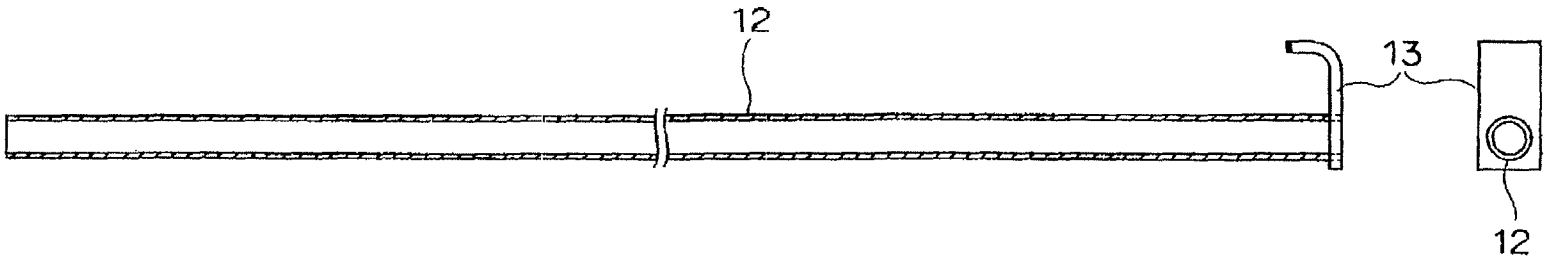
FIG. 5A is a view showing a pipe-shaped first terminal rod and a connection plate.
Figure 7:
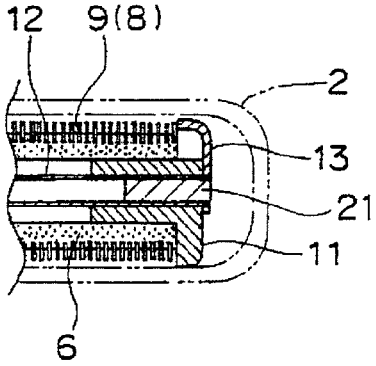
FIG. 7 is a view showing a state where the first terminal rod is packed with a thermal insulator.

Referring again to FIG. 1, inside the immersion heater 1, the first terminal rod 12 made of, for example, a stainless steel pipe is inserted and arranged along an axis core. A fore-end of the first terminal rod 12 is inserted into the through-hole 12*a* of the cylindrical-body supporting member 11 on the fore-end side, and from there, extends through the inside of the cylindrical body 6 backward, and passes through the through-hole 12*a* of the cylindrical-body supporting member 11 on the back-end side and the through-hole 5*a* of the cover 4. The first terminal rod 12 has a terminal plate for power-supply terminal block 12*c* at a back-end portion projected from the cover 4 backward. Moreover, as shown in FIGS. 5A and 6, the connection plate 13 having a side surface formed into a substantially L shape is joined and fixed to the fore-end of the first terminal rod 12, and an end portion of the connection plate 13 is electrically connected to the fore-end of the heating element 8. As shown in FIG. 7, packing a fore-end opening of the first terminal rod 12 with a thermal insulator 21 can prevent molten metal from flowing outside through an inside of the first terminal rod 12 even if a fore-end portion of the protecting tube 2 is damaged.

Moreover, the first terminal rod 12 is in a state where it is contained in an insulating cylindrical spacer 14 between the cylindrical-body supporting member 11 on the back-end side and the cover 4. The spacer 14 plays a role of restricting an interval between the cover 4 and the cylindrical-body supporting member 11, which can make the position of the cylindrical body 6 and the heating part 9 inside the protecting tube 2 precisely constant.

Outside the cover 4, a fastener 18 made of, for example, a metal washer is fixed to the first terminal rod 12, and a coil spring (compression spring) 19 is mounted on an outer circumference of the first terminal rod 12 between this fastener 18 and the cover 4 in a compressed state. This allows a tension to be constantly given to the first terminal rod 12, and this tension acts on the cylindrical body 6 through the pair of front and back cylindrical-body supporting members 11, 11, and thus, together with the positioning action of the spacer 14, the foregoing action allows the fixation of the cylindrical body 6 to be firmly maintained, and further can suppress deformation due to thermal expansion of the first terminal rod 12.

Moreover, the thermocouple 20 is inserted and arranged inside the pipe-shaped first terminal rod 12. The thermocouple 20 is inserted from the back-end portion of the first terminal rod 12, and the fore-end thereof is located inside the cylindrical body 6 holding the heating part 9. This enables the precise temperature measurement inside the cylindrical body 6 having the heating part 9. In a case where the thermocouple 20 is not provided, the first terminal rod 12 may be a solid rod.

Figure 5B:
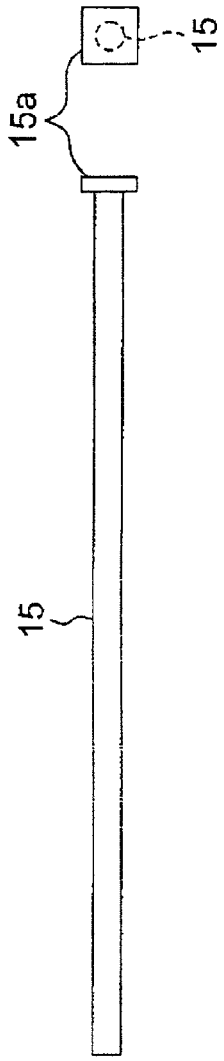
FIG. 5B is a view showing a rod-shaped second terminal rod and a connection plate.

Inside the immersion heater 1, the second terminal rod 15 made of a stainless steel rod is further inserted and arranged. The second terminal rod 15 passes through the through-hole 5*b* of the cover 4 and is inserted through the notched portion 12*b* of the cylindrical-body supporting member 11 on the back-end side, so that as shown in FIG. 5B, a connection plate 15*a* attached to a fore-end thereof is electrically connected to the back-end portion of the strip heating element 8. Moreover, the second terminal rod 15 has a terminal plate for power-supply terminal block 15*b* in a back-end portion.

A space between the cylindrical-body supporting member 11 on the back-end side and the cover 4 inside the protecting tube 2 is packed with a thermal insulator 16 made of, for example, ceramic fibers. This can suppress heat transfer from the spiral heating part 9 to the terminal part and prevent deformation due to thermal expansion of the terminal rod 15, and further, in the case of the horizontal dip method, can prevent outflow of the molten metal when the protecting tube 2 is damaged.

For example, in a state where the immersion heater 1 having the above-described configuration is attached to a side wall of an aluminum holding furnace, and is dipped in molten aluminum (molten metal), the power is fed through the first and second terminal rods 12, 15 to heat the heating part 9, by which the molten metal can be maintained at a desired temperature.

As described above, according to the immersion heater 1 of the present embodiment, since employing the strip one as the heating element 8 can increase a surface area of the heating element 8, the temperature of the heating element 8 can be kept lower at the same output as compared with the wire heating element, and durability is improved by suppression of scaling loss and the like.

Moreover, since the cylindrical-body supporting members 11 attached to both ends of the cylindrical body 6 holding the strip heating element 8 as the spiral heating part 9 each has the diameter smaller than the inner diameter of the protecting tube 2 and larger than the outer circumference diameter of the spiral heating part 9, the gap between the outer circumference border of the strip heating element 8 and the inner wall surface of the protecting tube 2 is securely formed, by which a situation where the outer circumference border of the spiral heating part 9 is pressed to the inner wall of the protecting tube 2 can be avoided, and as a result, the deformation due to the pressing of the outer circumference border of the strip heating element 8 is not caused, and the disconnection by the contact between adjacent portions of the strip heating element 8 can be securely avoided.

The invention claimed is:

1. An immersion heater comprising a ceramic bottomed protecting tube, an insulating cylindrical body inserted into said ceramic bottomed protecting tube, a metal heating element held inside a spiral groove formed in an outer circumference surface of said insulating cylindrical body, an insulating cover closing an opening portion of said ceramic bottomed protecting tube, and first and second terminal rods, one-end portions of which are connected to a fore-end portion and a back-end portion of said metal heating element, respectively, and other-end portions of which pass through said insulating cover and are located outside said ceramic bottomed protecting tube, wherein:

said metal heating element is a strip heating element, and one edge portion of said strip heating element is inserted into, and held in said spiral groove to form a spiral heating part, cylindrical-body supporting members that each have a diameter smaller than an inner diameter of said ceramic bottom protecting tube and larger than an outer diameter of the spiral heating part and are fitted into a hollow portion of said insulating cylindrical body are arranged in openings at a fore-end side and a back-end side of said insulating cylindrical body, respectively, a through-hole through which said first terminal rod connected to the fore-end portion of said metal heating element passes, and a notched portion through which a connection plate joined and fixed to a fore-end of said first terminal rod is inserted are formed in said cylindrical-body supporting member on the fore-end side, and a through-hole through which said first terminal rod passes, and a notched portion through which a connection plate joined and fixed to a fore-end of said second terminal rod is inserted are formed in said cylindrical-body supporting member on the back-end side.

2. The immersion heater according to claim 1, wherein a space between said cylindrical-body supporting member on the back-end side and said cover inside said protecting tube is packed with a thermal insulator.

3. The immersion heater according to claim 1, wherein an outer circumference portion on an opening end portion side of said ceramic bottomed protecting tube is formed into a taper shape that is tapered toward a fore-end thereof.

4. The immersion heater according to claim 1, wherein said terminal rod fixed to said cylindrical-body supporting member on the fore-end side so as to be connected to the fore-end portion of said metal heating element passes through said cylindrical body, said cylindrical-body supporting member on the back-end side and said cover to extend, and wherein a compression spring is arranged between a fastener provided in said terminal rod and said cover outside said cover.

5. The immersion heater according to claim 1, wherein said terminal rod connected to the fore-end portion of said metal heating element is formed into a pipe shape, and a thermocouple is inserted into, and arranged in said pipe-shaped terminal rod.

6. The immersion heater according to claim 5, wherein a fore-end opening of said pipe-shaped terminal rod is packed with a thermal insulator.

7. The immersion heater according to claim 1, wherein an insulating cylindrical spacer is arranged between said cylindrical-body supporting member on the back-end side and said cover in a state where said insulating cylindrical spacer contains said terminal rod.

8. The immersion heater according to claim 1, wherein a plurality of through-openings are formed in a wall of said insulating cylindrical body.

9. An immersion heater comprising a ceramic bottomed protecting tube, an insulating cylindrical body inserted into said ceramic bottomed protecting tube, a metal heating element held inside a spiral groove formed in an outer circumference surface of said insulating cylindrical body, an insulating cover closing an opening portion of said ceramic bottomed protecting tube, and first and second terminal rods, one-end portions of which are connected to a fore-end portion and a back-end portion of said metal heating element, respectively, and other-end portions of which pass through said insulating cover and are located outside said ceramic bottomed protecting tube, wherein:

said metal heating element is a strip heating element, and one edge portion of said strip heating element is inserted into, and held in said spiral groove to form a spiral heating part, cylindrical-body supporting members that each have a diameter smaller than an inner diameter of said ceramic bottom protecting tube and larger than an outer diameter of the spiral heating part and are fitted into a hollow portion of said insulating cylindrical body are arranged in openings at a fore-end side and a back-end side of said insulating cylindrical body, respectively, and said terminal rod connected to the fore-end portion of said metal heating element is formed into a pipe shape, and a thermocouple is inserted into, and arranged in said pipe-shaped terminal rod.

10. The immersion heater according to claim 9, wherein a fore-end opening of said pipe-shaped terminal rod is packed with a thermal insulator.

11. An immersion heater comprising a ceramic bottomed protecting tube, an insulating cylindrical body inserted into said ceramic bottomed protecting tube, a metal heating element held inside a spiral groove formed in an outer circumference surface of said insulating cylindrical body, an insulating cover closing an opening portion of said ceramic bottomed protecting tube, and first and second terminal rods, one-end portions of which are connected to a fore-end portion and a back-end portion of said metal heating element, respectively, and other-end portions of which pass through said insulating cover and are located outside said ceramic bottomed protecting tube, wherein:

said metal heating element is a strip heating element, and one edge portion of said strip heating element is inserted into, and held in said spiral groove to form a spiral heating part, cylindrical-body supporting members that each have a diameter smaller than an inner diameter of said ceramic bottom protecting tube and larger than an outer diameter of the spiral heating part and are fitted into a hollow portion of said insulating cylindrical body are arranged in openings at a fore-end side and a back-end side of said insulating cylindrical body, respectively, and an insulating cylindrical spacer is arranged between said cylindrical-body supporting member on the back-end side and said cover in a state where said insulating cylindrical spacer contains said terminal rod.

* * * * *